US005653662A

United States Patent [19]

Rodgers, Jr.

[11] Patent Number: 5,653,662

[45] Date of Patent: Aug. 5, 1997

[54] STATIONARY EXERCISE APPARATUS

[76] Inventor: Robert E. Rodgers, Jr., 8011 Meadowcroft, Houston, Tex. 77063

[21] Appl. No.: 652,962

[22] Filed: May 24, 1996

[51] Int. Cl.[6] ..... A63B 69/16; A63B 22/04

[52] U.S. Cl. ..... 482/52; 482/51; 482/70

[58] Field of Search ..... 482/51–53, 54, 482/57, 70–71, 74, 79, 80, 92, 62

[56] References Cited

U.S. PATENT DOCUMENTS

| | | | |
|---|---|---|---|
| 219,439 | 9/1879 | Blend . | |
| 2,603,486 | 7/1952 | Hughes . | |
| 3,316,898 | 5/1967 | Brown . | |
| 3,432,164 | 3/1969 | Deeks . | |
| 3,759,511 | 9/1973 | Zinkin et al. . | |
| 4,053,173 | 10/1977 | Chase, Sr. . | |
| 4,188,030 | 2/1980 | Hooper . | |
| 4,379,566 | 4/1983 | Titcomb . | |
| 4,456,276 | 6/1984 | Bortolin . | |
| 4,509,742 | 4/1985 | Cones . | |
| 4,555,109 | 11/1985 | Hartmann . | |
| 4,561,318 | 12/1985 | Schirrmacher . | |
| 4,645,200 | 2/1987 | Hix . | |
| 4,679,786 | 7/1987 | Rodgers . | |
| 4,720,093 | 1/1988 | Del Mar . | |
| 4,869,494 | 9/1989 | Lambert, Sr. . | |
| 4,900,013 | 2/1990 | Rodgers, Jr. . | |
| 4,949,954 | 8/1990 | Hix . | |
| 4,949,993 | 8/1990 | Stark et al. . | |
| 4,989,857 | 2/1991 | Kuo . | |
| 5,039,087 | 8/1991 | Kuo . | |
| 5,039,088 | 8/1991 | Shifferaw . | |
| 5,131,895 | 7/1992 | Rogers, Jr. . | |
| 5,135,447 | 8/1992 | Robards, Jr. et al. . | |
| 5,186,697 | 2/1993 | Rennex . | |
| 5,242,343 | 9/1993 | Miller . | |
| 5,279,529 | 1/1994 | Eschenbach | 482/52 |
| 5,290,211 | 3/1994 | Stearns . | |
| 5,295,928 | 3/1994 | Rennex . | |
| 5,299,993 | 4/1994 | Habing . | |
| 5,383,829 | 1/1995 | Miller . | |
| 5,401,226 | 3/1995 | Stearns . | |
| 5,423,729 | 6/1995 | Eschenbach . | |
| 5,499,956 | 3/1996 | Habing et al. | 482/52 |

FOREIGN PATENT DOCUMENTS

| | | |
|---|---|---|
| 2919494 | 5/1979 | Germany . |

OTHER PUBLICATIONS

U.S. Serial No. 08/377,846 filed Jan. 25, 1995, Robert E. Rodgers, Jr.

*Primary Examiner*—Stephen R. Crow

*Attorney, Agent, or Firm*—Pravel, Hewitt, Kimball & Krieger

[57] ABSTRACT

A stationary exercising device which promotes cardiovascular exercise yet minimizes impact to critical joints, particularly the ankles and knees. A frame supports a linkage assembly having at least one linkage member with a camming surface. The linkage assembly is in turn connected to a coupling assembly attached to the frame. Structure is included which permits each foot of the user to move the linkage assembly in such a manner as to generate a preferred closed path movement for the feet and a preferred arcuate path for the hands minimizing unnecessary stress in the joints yet permitting a cardiovascular workout of both lower and upper body muscle groups.

14 Claims, 3 Drawing Sheets

104
47
16
10
42
41
45
43
38
24
20
39
50
54
40
27
14
37
22
24
50
32
38
30
102
26
32
28
37
32a
36
32b
12

STATIONARY EXERCISE APPARATUS

BACKGROUND OF THE INVENTION

1. Field of the Invention

The present invention relates to an improved stationary exercising apparatus. More particular, the invention relates to an improved exercising apparatus which enables the user to move his feet in a predetermined closed path which more accurately represents the body motion associated with climbing stairs.

2. Description of the Prior Art.

Stair climbing is a popular form of exercise for the cardiovascular system. However, it can over prolonged use overstress the ankles, knees and other joints. Walking is also a popular form of exercise but it does not load the cardiovascular system to the extent stair climbing does. Therefore, the need exists for an improved stationary exercising device which will load the cardiovascular system as stair climbing does but does not overload or unduly stress the ankles, knees and other joints. Prior art stair climbing devices have two common draw backs. First, they require excessive lifting of the knees or an exaggerated vertical movement of the lower legs. See, for example, U.S. Pat. Nos. 3,316,898; 4,949,993; 4,989,857; and 5,135,477. Alternatively, the devices which do tend to promote a more natural movement of the knees and ankles are difficult to ascend and descend because of the configuration of the devices. See, for example, U.S. Pat. No. 5,242,343.

Hence, the need exists for an improved stationary exercise device which promotes the movements of the feet, ankles and legs in a more natural and rhythmic motion.

SUMMARY OF THE INVENTION

Briefly, the invention relates to an improved stationary exercising device. A frame is provided which includes a base portion adapted to be supported by the floor, a mid portion and a top portion. A coupling assembly is attached to the frame which includes a pulley defining a pivot axis. Two reciprocating members are positioned in spaced relationship to the base portion of the frame. In the preferred embodiment, each reciprocating member includes a rearward bent portion and is supported by the base portion proximate the junction of the bent and straight portions of each reciprocating member by a roller. The other, or forward, end of each reciprocating member is attached, directly or indirectly, to the pulley of the coupling assembly. In this manner, rotation of the pulley rotates one end of each reciprocating member in a circular motion while the other end of each reciprocating member moves in a predetermined closed path.

The preferred embodiment also includes a pair of linkage assemblies. Each linkage assembly comprises a first and second link. The first link is pivotally connected at one end to the rearward end of the corresponding reciprocating member. This first link also includes a foot pad. The second link is pivotally connected to the other end of the first link and the second link is then pivotally connected to the top portion of the frame. The second link may include a handle portion which is grasped by the user. Thus, each linkage assembly serves to define a predetermined closed path for the movement of the foot pad as it moves relative to the frame. In addition, movement of the second link of each linkage assembly serves to pivot the handle portion.

In an alternate embodiment, each reciprocating member comprises two non-aligned members fixedly attached to one another. A roller is attached to each reciprocating member at the fixed attachment of two non-aligned members. The roller engages an inclined surface of the base portion of the frame. As in the case of the preferred embodiment, this alternate embodiment also includes a pair of linkage assemblies each comprising two links. The first link includes a foot pad which is pivotally connected proximate one end of the first link to a corresponding reciprocating member distal the coupling assembly. The second link is pivotally connected to the other end of the first link distal said foot pad and the second link is then pivotally connected distal said pivotal connection of the first link, to said top portion of said frame. As in the case of the preferred embodiment, the second link may include a handle portion.

In yet another alternate embodiment, the reciprocating member comprises two non-aligned members which are fixedly connected at one end. A roller is also attached to each reciprocating member at that fixed connection. The roller serves to engage an inclined surface of the base portion of the frame. In this alternate embodiment, however, the inclined surface serves to rise in a forward position away from the coupling assembly. That is, the user will face away from the coupling assembly, unlike the alternate embodiment previously described.

As in the case of the first alternate embodiment, this second alternate embodiment also includes a pair of pivotal linkage assemblies comprising a first link and a second link. Each foot link includes a foot pad. The forward end of each reciprocating member distal said coupling assembly is pivotally connected proximal one end of each first link. The other end of each first link is pivotally connected to one end of said second link. Each second link is then pivotally connected distal said pivotal connection to said first link, to said top portion of said frame. As in the case of the previous embodiments, the second link may include a handle portion.

All the embodiments serve to exercise both upper and lower body groups. The feet of the user move through a closed path which more accurately represents a preferred anatomical movement of the ankles and knees. Simultaneously, the upper body muscle groups can be exercised through the arcuate motion of the handles.

The more important features of this invention have been summarized rather broadly in order that the detailed description may be better understood. There are, of course, additional features of the invention which will be described hereafter and which will also form the subject of the claims appended hereto.

BRIEF DESCRIPTION OF THE DRAWINGS

In order to more fully describe the drawings used in the detailed description of the present invention, a brief description of each drawing is provided.

DETAILED DESCRIPTION OF PRESENT INVENTION

Figure 1:
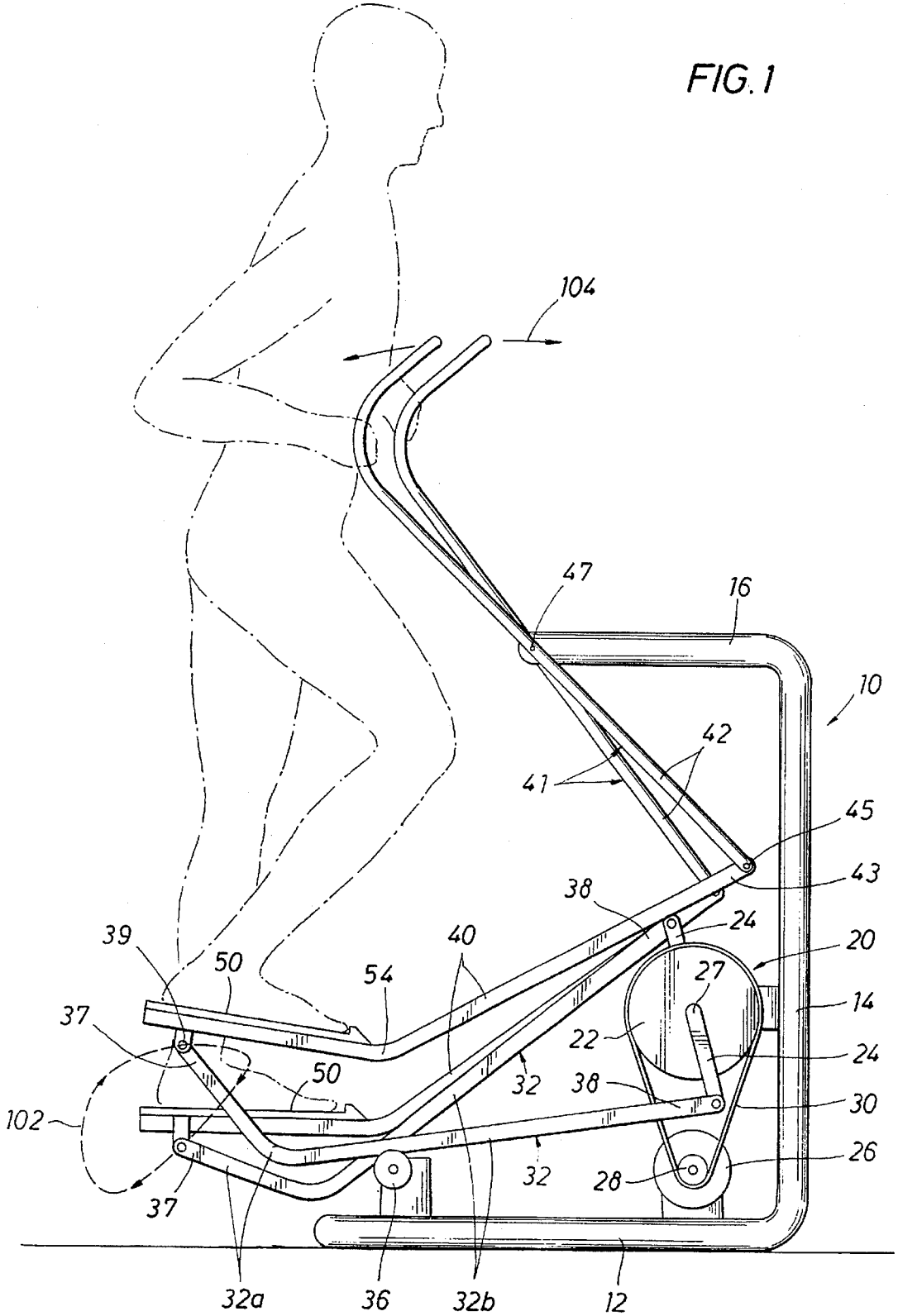
FIG. 1 is an elevation view of the preferred embodiment of the present invention.

Referring to FIG. 1, a frame 10 is shown comprising a base portion 12, a mid portion 14, and a top portion 16. A coupling assembly or system 20 is fixed relative to the frame and comprises a pulley 22 and crank members 24. A resistant brake system 26 is also shown which includes a sheave 28 and a belt 30. Two reciprocating members 32 are positioned in the lower proximity of frame 10. Each reciprocating member 32 has a bent (or non-aligned) portion 32*a* relative to straight portion 32*b*. The other end 38 of each reciprocating member 32 is pivotally connected to one end of a crank 24. The other end of crank 24 is attached to pulley 22 at the pivot axis 27 of the coupling system 20. The pivot axis 27 is the axis about which pulley 22 rotates.

The preferred embodiment also includes a pair of linkage assemblies 41. Each linkage assembly 41 comprises a foot member 40 and an arm member 42. A foot pad 50 is attached to one end of each foot member 40. End 37 of each reciprocating member 32 is pivotally connected to that end of foot member 40 adjacent foot pad 50 at pivotal connection 39. The other end 43 of each foot member 40 is pivotally connected to one end of an arm member 42 at connection 45. Each arm member 42 is then pivotally connected at connection 47 to top portion 16 of frame 10. As shown, each foot member 40 may include a bend 54 which serves to orient each foot pad 50, and consequently each foot of the user, in a slightly declining position when the foot pad is at its highest most point along path 102.

Further, the upper half of each arm member 42 may be releasably disengaged proximate connection 47 as shown and described in Applicannt's copending U.S. patent application Ser. No. 08/653.333 filed May 24, 1996 which specification is hereby incorporated by reference and made a part of this patent application.

In the operation of the preferred embodiment the user "U" ascends the present invention from the back or the sides and begins a climbing motion which results in the displacement of each reciprocating member 32 relative to a roller 36. Simultaneously, a circulating motion occurs at the second end 38 of each reciprocating member 32. This also results in the revolution of point 39 at end 37 of each reciprocating member (and the corresponding end of foot member 40) in a predetermined closed ovate path 102. This provides a more natural and rhythmic movement for the feet, ankles and legs. In this manner the user can achieve the superior cardiovascular workout associated with a stair climber but without the awkward and unnatural movement of the feet, ankle, knees and legs associated with prior art devices. Simultaneously, the arms of the user move through arcuate path 104 which provides enhanced cardiovascular exercise to the upper body muscle groups.

Resistant brake system 26 operates in a manner well known to those skilled in the art. Resistant brake 26 serves to increase or decrease the load on pulley 22 through the sheave 28/belt 30 arrangement. Thus, resistant brake 26 serves to increase or decrease the extent of the cardiovascular workout.

Figure 2:
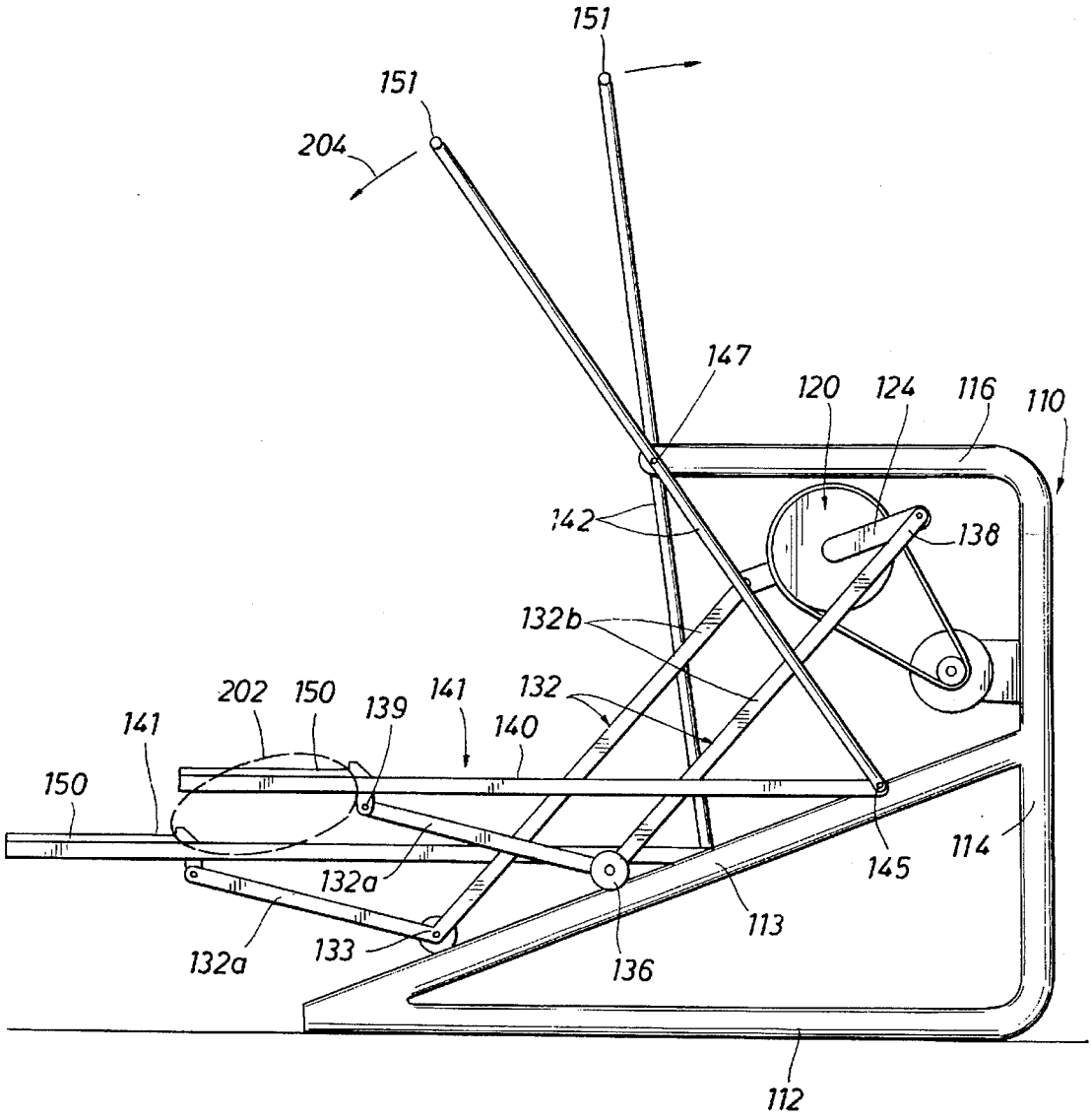
FIG. 2 is an elevation view of an alternate embodiment of the present invention.

Referring now to FIG. 2, an alternate embodiment of the present invention is shown. For this embodiment, identical two-digit reference numerals will be used to designate similar structure found in the preferred embodiment but with a 100 series prefix. Frame 110 comprises a lower portion 112, a mid portion 114, and a top portion 116. A coupling system 120 is included having identical components of the coupling system 20 described above for the preferred embodiment. Furthermore, coupling system 120 performs in an identical manner to coupling system 20 described above for the preferred embodiment.

A pair of reciprocating members 132 are also included. Each reciprocating member is comprised of two non-aligned members 132*a* and 132*b* which are fixedly connected at junction 133. A roller 136 is also rotatably connected to each reciprocating member 132 at junction 133. Each roller engages and rolls upon inclined member 113 of frame 110. A second end 138 of each reciprocating member 132 is pivotally connected to one end of each crank 124.

Referring still to FIG. 2, this alternate embodiment also includes a pair of linkage assemblies 141, each comprising a foot member 140 and an arm member 142. Each foot member 140 also includes a foot pad 150 attached to one end of foot member 140. A reciprocating member 132 is pivotally connected at connection 139 proximate that end of foot member 140 having foot pad 150. The other end of each foot member 140 is pivotally connected at 145 to an arm member 142. Each arm member 142 is then pivotally connected at 147 to top portion of 116 of frame 110. Arm member 142 may include handle portions 151.

In the operation of this alternate embodiment, the user "U" ascends the device from the side or the rear, places both feet on pads 150, grabs handles 151 and begins a climbing motion. At that point, rollers 136 of each reciprocating member 132 are displaced in a linear manner along member 113. As in the case of the preferred embodiment, ends 138 of each reciprocating member 132 move in a circular motion about pulley 122. Such movement of reciprocating member 132 also results in the revolution of point 139 at the end of each reciprocating member and corresponding foot member 140 in a predetermined and preferred closed ovate path 202. As in the case of the preferred embodiment, such a path provides a more natural movement of the feet, ankles and legs. Additionally, the hands of the user move in arcuate path 204. Thus, the combined movement of paths 202 and 204 provide superior cardiovascular workout of both the lower and upper body muscle groups.

Figure 3:
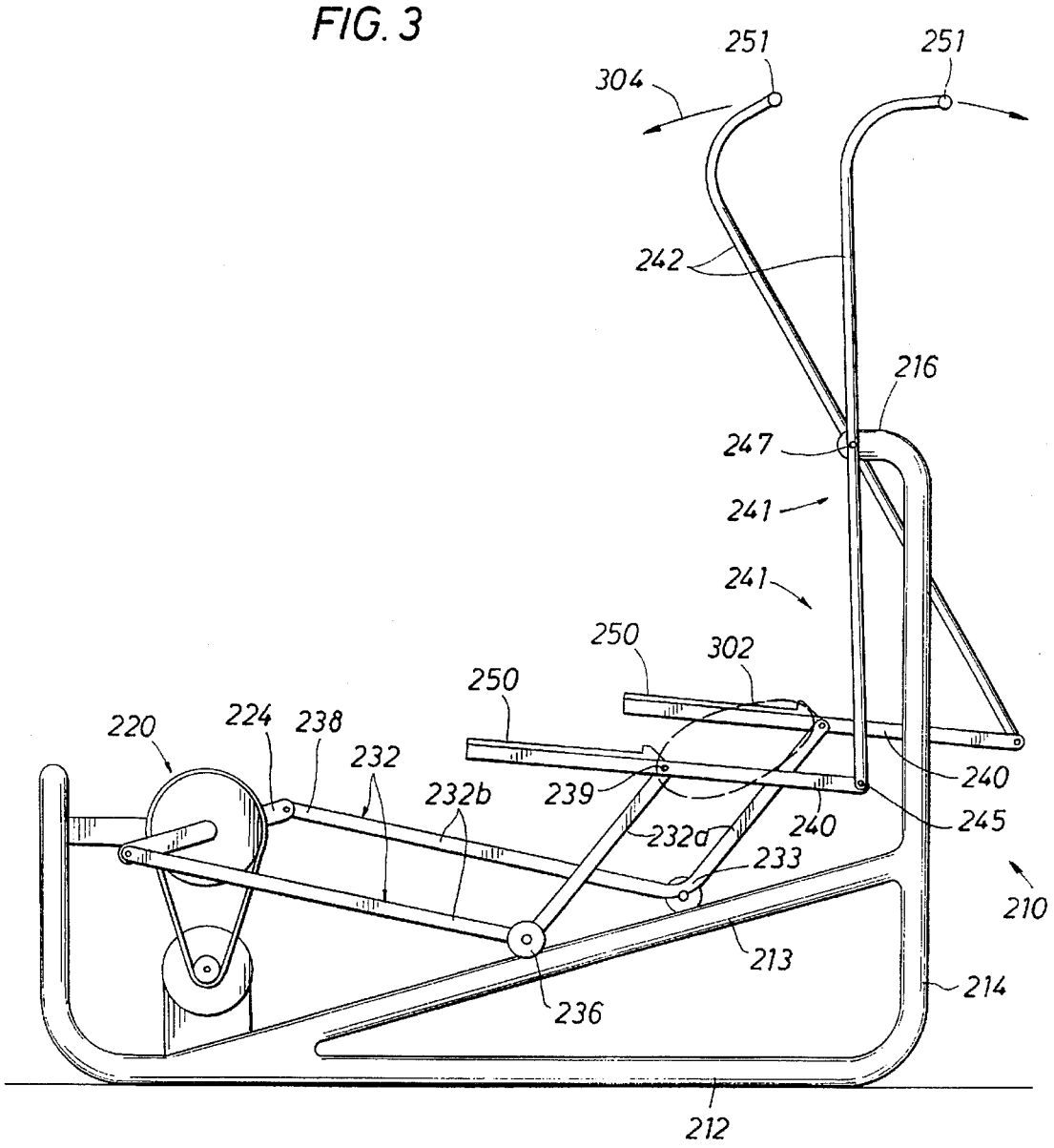
FIG. 3 is an elevation view of another alternate embodiment of the present invention.

Referring now to FIG. 3, another alternate embodiment of the present invention is shown. As before, similar parts will be designated by the same two-digit reference numeral as shown in the preferred embodiment but now with a 200 series prefix. Frame 210 again comprises a base portion 212, a mid portion 214 and a top portion 216. A coupler system 220 is also provided which is identical in structure and function to coupling system 20 of the preferred embodiment. This alternate embodiment also includes a pair of reciprocating members 232. Each reciprocating member is comprised of two non-aligned members 232*a* and 232*b* which are fixedly connected at junction 233. A roller 236 is also rotatably connected to each reciprocating member 232 at junction 233. Each roller 236 engages and rolls upon inclined member 213 of frame 210. Each reciprocating member 232 includes a second end 238 pivotally attached to one end of a crank 224.

Referring still to FIG. 3, as in the case of the previous embodiments, this alternate embodiment also includes a pair of pivotal linkage assemblies 241. Each pivotal linkage assembly 241 is comprised of a foot member 240 and an arm member 242. A foot pad 250 is attached to one end of each foot member 240. A member 232*a* of each reciprocating member 232 is pivotally connected at connection 239 proximate one end of foot member 240. The other end of each member 240 is pivotally connected at 245 to one end of arm member 241. Each arm member 241 is then pivotally connected to top portion 216 of frame 210 at point 247.

In the operation of this alternate embodiment, the user "U" ascends the device from the side or the rear grabs the handles 257 and begins a climbing motion. Unlike the previous embodiments, the user faces away from the coupling system 220 which may have certain advantages, particularly in the manufacture of this device. As the user begins the climbing motion, roller 236 of each reciprocating member 232 moves in a linear motion along member 213 and ends 238 of each reciprocating member 232 move in a generally circular motion. Simultaneously, point 239 of each reciprocating member 232 moves in a predetermined closed path 302 while handles 251 move in an arcuate path 304. As in the case of the preferred embodiments, such paths 302 and 304 provide preferred anatomical movement of the ankles and knees thereby providing superior cardiovascular workout for the lower and upper body muscle groups.

In the case of all three embodiments, only the general middle portion of each reciprocating member 32/132/232 rotatably engages the base frame. In the case of the two alternate embodiments, the middle portion is more clearly defined by the location of rollers 136 and 236. In the case of the preferred embodiment, roller 36 which is fixed to base portion 12 of frame 10 is adapted to engage a middle portion of each reciprocating member 32 generally as shown by the two variations in displacement illustrated by the two reciprocating members 32 in FIG. 1.

An improved stationary exercising device is disclosed which maximizes cardiovascular exercise yet minimizes stress on critical joints, particularly the ankles and knees. Obviously, modifications and alternations to the embodiments disclosed herein will be apparent to those skilled in the art in view of this disclosure. However, it is intended that all such variations and modifications fall within the spirit and scope of this invention as claimed.

What is claimed is:

1. An apparatus for exercising comprising:

a frame having a base portion adapted to be supported by a floor;

first and second reciprocating members, each reciprocating member having a first and a second end and a middle portion, said middle portion of each member adapted to be rotatably supported by said frame;

coupling means for rotating the second ends of said first and second reciprocating members in a substantially circular path about a common axis while said first end of each of said first and second reciprocating members follows a predetermined closed ovate path;

first linkage assembly having a first foot member and a first arm member, said first foot member pivotally connected to said first reciprocating member proximate said first end of said first reciprocating member, said pivotal connection being proximal one end of said first foot member, and said first foot member pivotally connected at its other end to one end of said first arm member, said first arm member pivotally connected to said frame proximal the other end of said first arm member; and second linkage assembly having a second foot member and a second arm member, said second foot member pivotally connected to said second reciprocating member proximate said first end of said second reciprocating member, said pivotal connection being proximal one end of said second foot member, and said second foot member pivotally connected at its other end to one end of said second arm member, said second arm member pivotally connected to said frame proximal the other end of said second arm member, wherein each foot of the user of the device substantially follows said closed ovate path and each hand of the user follows a substantially arcuate path.

2. The exercising apparatus according to claim 1 wherein said reciprocating members comprise non-aligned portions.

3. The exercising apparatus according to claim 1 wherein said frame includes at least one inclined member relative to the floor to support said reciprocating members.

4. The exercising apparatus according to claim 1 wherein said apparatus further comprises means for introducing a controllable resistive force to said pulley.

5. The exercising apparatus according to claim 4 further comprising means for disengaging at least a portion of said arm members eliminating the arcuate path.

6. An exercise apparatus comprising:

a frame having a base portion adapted to be supported by a floor;

a first linkage assembly having a first reciprocating member, a first foot member and a first arm member, said first reciprocating member having first and second non-aligned portions and being adapted for linear movement on said frame proximate the junction of said non-aligned portions, said first foot member having a first and second end, said first foot member being pivotally attached proximate said first end of said first foot to one end of said first reciprocating member, said first foot member being pivotally connected at its second end to one end of said first arm member, said arm member pivotally connected to said frame proximal the other end of said first arm member;

a second linkage assembly having a second reciprocating member, a second foot member, and a second arm member, said second reciprocating member having first and second non-aligned portions being adapted for linear movement on said frame proximate the junction of said non-aligned portions of said second reciprocating member, said second foot member having a first and second end, said second foot member being pivotally attached proximate said first end of said second foot member to one end of said second reciprocating member, said second foot member being pivotally connected at its second end to one end of said second arm member, said second arm member pivotally connected to said frame proximal the other end of said second arm member; and coupling assembly having a pulley supported by said frame defining a pivot axis and means for attaching said second ends of said first and second reciprocating members to said pulley so that rotation of said pulley results in the rotation of the second ends of said reciprocating members in a substantially circular path about said axis, wherein each foot of the user of the device follows a predetermined closed path having a preferred anatomical pattern and the hands of the user followed a predetermined arcuate path.

7. The exercising apparatus according to claim 6 wherein said frame includes at least one inclined member relative to the floor to support said reciprocating members.

8. The exercising apparatus according to claim 6 wherein said apparatus further comprises means for introducing a controllable resistive force to said pulley.

9. The exercising apparatus according to claim 6 further comprising means for disengaging at least a portion of said arm members eliminating the arcuate path.

10. The exercising apparatus according to claim 6 wherein said coupler assembly attaching means comprises:

a first element attached at one end to said pulley proximate said pivot axis and at its other end to said second end of said first reciprocating member; and a second element attached at one end to said pulley proximate said pivot axis and at its other end to said second end of said second reciprocating member.

11. An apparatus for exercising comprising:

a frame having a base portion adapted to be supported by a floor;

first and second reciprocating members, each reciprocating member having a first and a second non-aligned portions and being adapted for linear movement on said frame proximate the junction of said non-aligned portions;

coupling means for rotating the second ends of said first and second reciprocating members in a substantially circular path about a common axis while said first end of each of said first and second reciprocating members follows a predetermined closed ovate path;

first linkage assembly having a first foot member and a first arm member, said first foot member pivotally connected to said first reciprocating member proximate one end of said first reciprocating member, said pivotal connection being proximal one end of said first foot member, and said first foot member pivotally connected at its other end to one end of said first arm member, said first arm member pivotally connected to said frame proximal the other end of said first arm member; and second linkage assembly having a second foot member and a second arm member, said second foot member pivotally connected to said second reciprocating member proximate one end of said second reciprocating member, said pivotal connection being proximal one end of said second foot member, and said second foot member pivotally connected at its other end to one end of said second arm member, said second arm member pivotally connected to said frame proximal the other end of said second arm member, wherein each foot of the user of the device substantially follows said closed ovate path and each hand of the user follows a substantially arcuate path.

12. The exercising apparatus according to claim 11 wherein said frame includes at least one inclined member relative to the floor to support said reciprocating members proximate said non-aligned portions.

13. The exercising apparatus according to claim 11 wherein said apparatus further comprises means for introducing a resistive force so rotation of said second ends of said first and second reciprocating members becomes progressively more difficult.

14. The exercising apparatus according to claim 11 further comprising means for disengaging at least a portion of said first and second arm members eliminating the arcuate path.

* * * * *